US005133819A

United States Patent [19]

Croner

[11] Patent Number: 5,133,819

[45] Date of Patent: Jul. 28, 1992

[54] PROCESS FOR PRODUCING DECORATIVE ARTICLES

[76] Inventor: Marjorie Croner, 8690 Cobb Rd., Manassas, Va. 22111

[21] Appl. No.: 517,247

[22] Filed: May 1, 1990

[51] Int. Cl.[5] ..... B44C 1/00

[52] U.S. Cl. ..... 156/230; 156/235; 156/240; 156/289; 428/914

[58] Field of Search ..... 156/230, 235, 240, 289; 428/914

[56] References Cited

U.S. PATENT DOCUMENTS

| | | | |
|---|---|---|---|
| 3,121,650 | 2/1964 | Meissner | 156/240 |
| 3,239,366 | 3/1966 | Miller et al. | 428/914 X |
| 3,376,182 | 4/1968 | Borell et al. | 156/235 |
| 3,408,216 | 10/1968 | Mott et al. | 428/914 X |
| 3,956,552 | 5/1976 | Geary | 427/200 X |

*Primary Examiner*—David A. Simmons
*Assistant Examiner*—James J. Engel, Jr.

[57] ABSTRACT

A process for reproducing a source image on a fabric, comprising providing a source image from a heat fused toner, providing a fabric having a heat activated adhesive coating on one side thereof, placing the fabric against the source image with the heat activated adhesive coating in contact with the source image, heating the fabric and the coating so as to activate the adhesive so that at least a portion of the image from the source is adhered to the adhesive, peeling the fabric away from the source, subsequently placing the transfer fabric onto a receiving fabric so that the adhesive and the image are in contact with the receiving fabric, and heating the transfer fabric and the adhesive so that the image is transferred to the receiving fabric, and removing the transfer fabric from the receiving fabric.

7 Claims, 1 Drawing Sheet

PROCESS FOR PRODUCING DECORATIVE ARTICLES

This invention relates to a process for producing decorative articles. More particularly, the invention relates to a dry process by which an article, such as a pillow, T-shirt, or the like, may be decorated with a faithful reproduction of a pattern, drawing, photograph or the like and then embellished by stitchery, coloring or other techniques.

BACKGROUND AND OBJECTS OF THE INVENTION

A variety of transfer printing processes have been described in the prior art and in commercially available products. For example, U.S. Pat. No. 3,985,602 of Stuart and 4,685,984 of Powers et al, both describe processes for transferring images from a paper sheet to another sheet which may, for instance be a fabric.

The Stuart patent describes a composite sheet which incorporates a paper carrier sheet with a transparent, thermoplastic sheet, and having an image retaining, pressure sensitive adhesive layer. A release layer on the adhesive permits a paper protective layer to be adhered until time to use the sheet. In use, the composite sheet is placed against a printed image on paper, and the pressure sensitive adhesive holds the image while the original paper backing is dissolved away by water. A source of heat, such as an iron, is used to cause a melting of the thermoplastic layer whereby the plastic, with the adhesive and the image are bonded to a fabric such as a shirt. Then, the paper carrier is removed.

The Powers patent teaches another image transfer process for transferring images from paper to fabric, but utilizes a different transfer medium. This process uses a water impervious, heat-resistant plastic support layer which has a high release coating, and which supports a contact adhesive, a thermoplastic layer and a protective layer. The sheet is placed against a sheet of paper bearing the image to be transferred, and the adhesive holds the image bearing paper to the transfer medium.

Next, the image carrying sheet is placed in a water wash to weaken and disintegrate the paper carrier, leaving the image adhered to the plastic carrier layer. This carrier is then placed against the fabric, and heat and pressure are applied to fuse the plastic and bond the image to the fabric, i.e. T-shirt. This process seems to depend heavily on differential release coatings, and the end product also includes a thermoplastic layer which serves as the transfer layer.

Another prior image transfer technique is taught in U.S. Pat. No. 3,607,526 to Biegen. This patent uses a contact, or pressure sensitive adhesive on a release sheet to pick up an image from a paper sheet. Thereafter, the paper sheet is dissolved with water, leaving the image adhered to the adhesive on the release sheet. Then, a solvent is used to enable the adhesive to be transferred from the release sheet to the desired surface.

These prior techniques utilize different transfer materials to remove an image from a source sheet onto a transfer layer, followed by the bonding of the transfer layer to the fabric. The transfer layer simply remains a part of the final product, albeit in a modified form.

One difficulty with these prior art techniques, is that the finally produced layer, after fusion, comprises a durable, stiff, shiny, rubbery protective covering for, or containing, the image on the fabric. While this is suitable, and indeed often desirable for an image which is to be only seen, and which is used to decorate T-shirts and must therefor withstand laundering, the plastic coating or layer makes the fabric very difficult or impossible to sew. For sewing machines, the presser foot tends to stick to the coating and not slide readily across the fabric, as it must.

Thus, the decorative possibilities are limited, essentially to printed matter, which most often is simply black and white in these processes. For this reason, these techniques are limited primarily to T-shirt ornamentation.

Techniques such as those described in these prior patents have been commercially available for some time under the trademarks "Transfer Magic" and "Fabulon". These commercially available products suggest the use of the transfer media with printed material or with photocopies of photographs, printed material or the like. Thus, it is at least theoretically possible to produce a color image transfer using a color photocopy. In practice, however, such color photocopies are not readily available as are the standard office type of plain paper copiers.

A further drawback of the prior techniques is the composite nature of the transfer sheets used with the processes. For example, the differential release coatings, the various polymer layers, the removable carrier layers, all contribute to making such products more expensive.

The present invention seeks to provide a process by which a good reproduction of an image may be produced on a fabric. The invention provides a further feature in that the fabric with the image according to the invention may be easily further ornamented by hobbyists or craftpersons by sewing, coloring, dyeing or even multiple printing. As used herein, the term sewing is intended to mean any of a variety of needlework techniques resembling sewing, as are commonly used for ornamental stitchery such as quilting, needlepoint, crewel, embroidery or the like.

In the past, a variety of fabrics for use in such stitchery techniques have been available with a design printed thereon, and the craftsperson would purchase the basic fabric and necessary thread, and proceed to perform the stitchery on the design or pattern printed on the fabric. When finished, the preprinted design was usually not visible as it was covered by the stitchery. However, the printed pattern was transformed into a multicolored reproduction of the printed pattern.

According to the present invention, once an image has been transferred onto a piece of fabric by the process, the user is able to perform conventional ornamentation techniques to embellish the image as desired.

Thus, a great advantage of the present invention is that the craftsperson may produce virtually any image on the fabric and transform that image into a multicolored replica of the original. For example, old family photographs may serve as the basis for, and be reproduced on pillow covers or pillows, using the present invention. Similarly, the invention may be used to produce articles of clothing such as scarves, blouses, or bed linens, or a great variety of other such ornamented produced. In each case, the finished product has a finish which is virtually the same as the starting fabric, rather than a glossy, rubbery coating.

Thus, a primary object of the present invention is to provide an improved image transfer process by which a desired image may be transferred from a source to a fabric.

Another object of the invention is to provide a process for reproducing an image on fabric such that the fabric may be further worked by sewing or similar stitchery techniques for ornamentation.

Still another object of the invention is to provide a greatly simplified process for transferring images from paper to cloth or similar fabrics.

Yet another object of the invention is to provide an image transfer process which does not coat the surface of the receiving fabric, thereby leaving the surface with its own properties.

Still a further object of the invention is to provide an image transfer process which may be used with fine fabrics such as silk, suede, nylon, or the like, and keep the same feel of such fabrics.

Yet a further object of the invention is to provide an image transfer process for tee shirts which will withstand repeated washings.

DESCRIPTION OF THE INVENTION

The present invention relies upon the use of a particularly suitable, readily available, transfer medium for removing the image and releasing or printing the image onto the desired substrate. Applicant has found that any of a variety of commercially available products known generally as iron-on mending fabrics or iron-on patches may be used as the transfer medium, in effect as a printing plate. Such mending fabrics are commonly used for repairing holes or tears in any of a variety of fabrics, simply by placing a piece of the mending fabric over the hole and ironing the mending fabric. Then it is allowed to cool.

Such mending fabrics generally have a strong backing fabric coated with a thermally activated adhesive, such as a vinyl chloride vinyl acetate copolymer. After the repair process, the backing fabric remains in place. For this reason, the mending fabrics typically are available in a variety of colors and textures to match the base fabric. However, for the purposes of this invention, the particular base fabric to be used is of no consequence, as it does not remain part of the finished product, but is merely an intermediate.

One such mending fabric is disclosed in U.S. Pat. No. 2,631,947 to Kline, et al, issued Mar. 17, 1953. This type of mending fabric has been available for many years under the trademark "Bondex" and a number of other similar products are also available. The adhesive used in these mending fabrics is typically a thermoplastic adhesive, which is capable of softening at temperatures within the range of normal irons used on fabrics, typically 300°–400° F.

Applicant has discovered that the adhesive used in such mending fabrics works quite well as a transfer medium for heat fused images, such as toner images which are produced by many photocopy machines currently in use. Such so-called plain paper photocopy machines typically use a toner which is fused by heat, with or without pressure, heat which is generally applied in a range similar to that used for such mending fabrics. Thus, by using a photocopy image of a desired photographs, artwork, design, or the like, a faithful reproduction of the original may be produced on a sheet of fabric.

Applicant has also discovered that the same process can be used for transferring other images, provided that the images are of an ink or toner which is heat releasable, such that upon the application of heat to the image, the image is softened to the point that it will be adhered to the adhesive layer on the mending fabric. In this manner, by placing the mending fabric on the source image, and heating the mending fabric and source with an iron, when the mending fabric is peeled away, it carries with it the image, which may be pencil, newsprint, inks, or the like, all of which are referred to as heat softenable images.

Starting with, for example, a photocopy of the desired original, a sheet of the mending fabric is placed over the photocopy with the adhesive side against the photocopy image, and heat is applied, for example by means of an iron, to heat the mending fabric and the photocopy to an appropriate temperature. When the appropriate temperature is reached, the iron is removed, and the mending fabric is peeled away from the photocopy.

At this point, the fabric may be allowed to cool, although it may be used immediately. Generally the material is easier to use and to position when it is cool.

The mending fabric at this point carries with it a reverse image of the photocopy. This is a result of the fact that a portion of the toner from the photocopy has been removed from the paper copy and is adhered to the adhesive of the mending fabric. Once cooled, the image will remain intact for use at some later time, or, of course, it may be used right away.

To transfer the image, the mending fabric is placed with the image facing and in contact with the desired fabric which is to receive the image, and the two layers are adjusted in such a manner that the image will be in the desired location. Then, by reheating the layers, again by means of an iron, the toner image is released from the adhesive and transferred to the fabric. The image produced is a faithful reproduction of the original.

Furthermore, when the image is applied as toner, the adhesive will usually remain essentially completely on the original mending fabric. Thus, there is no transfer of a plastic coating layer onto the receiving fabric, so that the receiving fabric retains its natural feel. In this manner, there is no bulky coating to prevent further ornamentation by sewing or other stitchery.

Further, the process does not require any special equipment such as heating plates or platens, nor does it require any special solutions or solvents for treating the adhesive or release layers. The mending fabric merely serves as a printing plate.

Applicant has also found that in many instances, the mending fabric containing the image thereon may be used more than once to produce successive images on other sheets or material, however, it is likely that each image will be lighter than the previous one.

A number of different toners are used by different photocopy machines, but while the toners may have slightly different compositions or fusing points, to fit the requirements of the particular copy machine, the differences are not significant for the present invention, and simple experimentation may be used to determine the precise iron temperature and heating time for a particular source image. Generally, the iron will be set on the "wool" setting, i.e. about 300°–350° F., and good results will be obtained. Generally, the hotter the iron, the more image will be picked up by the adhesive, when lifting the image, and similarly, the more of the adhesive will be released to the fabric when the image is being printed.

The transfer medium, may be any of a number of different iron-on patches available on the market. One line of such products is sold by Coats & Clark as "Iron-On Mending Fabric", and another such product is available under the trademark "Bondex".

After the mending fabric has been placed against the original photocopy, and heat applied through the iron, it is necessary to remove the fabric from the photocopy. This can be done either while the fabric is still hot, or after it has had an opportunity to cool. Generally, removing the mending fabric while hot is preferred for most photocopies, but for some photocopies, it is preferable to allow the fabric to cool to room temperature before removing the mending fabric.

DESCRIPTION OF THE DRAWINGS

The foregoing description, objects and advantages of this invention will become apparent from the further description of non-limiting examples of preferred embodiments which follow, with reference to the accompanying drawings, in which.

DESCRIPTION OF PREFERRED EMBODIMENTS

Figure 1:
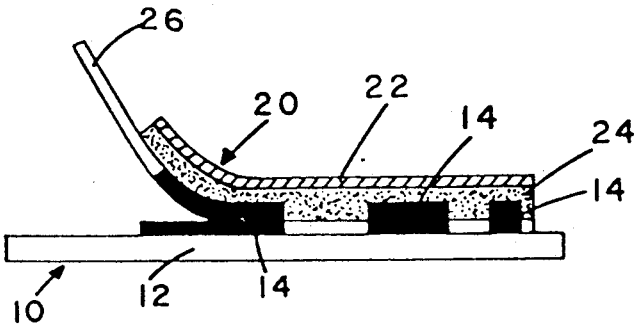
FIGS. 1, 2 and 3 are cross-sectional schematic representations of the process of the invention on an enlarged scale.

Referring to the drawings, a photocopy generally designated 10 consists basically of a sheet of paper 12 with toner images 14 thereon. This photocopy is made from any desired original source, such as a photograph, a drawing, a transparency, a magazine or newspaper article or headline, or any similar original.

An iron-on mending fabric generally designated 20 is seen to comprise a piece of backing fabric 22 with a layer 24 of a thermoplastic adhesive thereon. The mending fabric 20 is placed against the photocopy 10, with the adhesive against the toner images 14, and a hot iron (not shown), heated to an appropriate temperatures as discussed above, is placed on the mending fabric. The heat softens the adhesive layer 24 and makes it tacky, to the extent that at least some of the toner of the image 14 become adhered to the hot adhesive. Thereafter, by pulling up or peeling away using a handle strip such as 26 or simply peeling up a corner to start the removal, the mending fabric 20, with a toner image thereon, is removed. This mending fabric with the image can then be used as a printing plate.

To print with this printing plate, the mending fabric is placed against a receiving fabric 30 as shown in FIG. 2, and heat is again applied to the mending fabric. The mending fabric is then peeled off and removed, leaving the image transferred to the fabric 30. This image is essentially a true reproduction of the original source, reproduced initially as an image from the photocopy 10, which is of course a true copy of the original.

Figure 3:
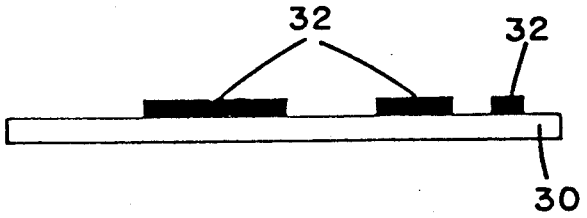
Figure 2:
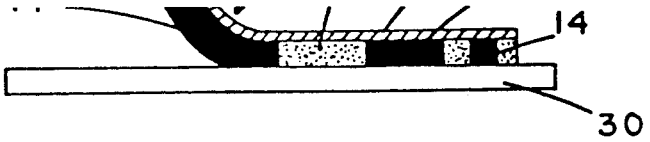
Figure 1:
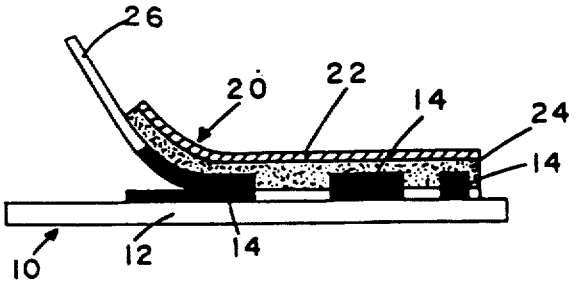
Figure 2:
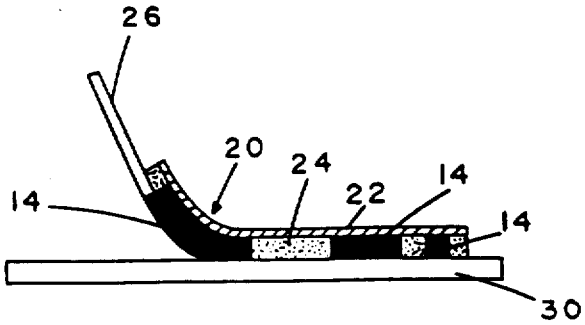
Figure 3:
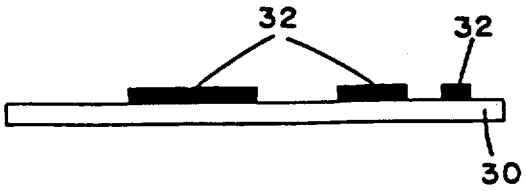

FIG. 3 illustrates the finished product bearing a reproduction 32 of the image 14 on the fabric 30. This fabric 30 may be any suitable fabric as may be desired by the craftsperson for the particular project. Suitable fabrics would include cotton, silk, linen, lace, satin, or the like, provided that the fabric itself is capable of withstanding the heat of the transfer process.

While this invention has been described as having certain preferred features and embodiments, it will be understood that it is capable of still further variation and modification without departing from the spirit of the invention, and this application is intended to cover any and all variations, modifications and adaptations of the invention as fall within the spirit of the invention and the scope of the appended claims.

I claim:

1. A process for transferring an image from a source to a fabric, comprising providing a source image of a heat releasable substance, placing an iron-on mending fabric having a heat activate adhesive coating on one side thereof against said source image with the heat activated adhesive coating in contact with said source image, heating said mending fabric and said coating so as to activate said adhesive so that at least a portion of the image from said source image is adhered to said adhesive, subsequently placing said mending fabric onto a receiving fabric so that said adhesive and said image are in contact with said receiving fabric, and heating said transfer fabric and said adhesive so that said image is transferred to said receiving fabric, and removing said mending fabric from said receiving fabric.

2. A process as in claim 1 and including the step of ornamenting the printed image on said receiving fabric by a stitchery technique.

3. A process as in claim 1 and wherein said source comprises a photograph.

4. A process for reproducing a source image on a receiving fabric, comprising preparing a photocopy of the source using a heat fused toner, providing an iron-on mending fabric having a heat activated adhesive coating on one side thereof, placing said mending fabric against said photocopy with the heat activated adhesive coating in contact with said photocopy, heating said mending fabric and said coating so as to activate said adhesive so that at least a portion of the image from said photocopy is adhered to said adhesive, peeling said mending fabric away from said photocopy, subsequently placing said mending fabric onto a receiving fabric so that said adhesive and said image are in contact with said receiving fabric, and heating said mending fabric and said adhesive so that said image is transferred to said receiving fabric, and removing said mending fabric and said adhesive from said receiving fabric.

5. A process as in claim 4 and including removing said mending fabric from said photocopy while said mending fabric and said adhesive are hot.

6. A process as in claim 4 and including allowing said mending fabric and said adhesive to cool, and subsequently removing said mending fabric from said photocopy.

7. A process as in claim 5 and including ornamenting said receiving fabric by a stitchery technique.

* * * * *

UNITED STATES PATENT AND TRADEMARK OFFICE

CERTIFICATE OF CORRECTION

PATENT NO. : 5,133,819

DATED : Jul. 28, 1992

INVENTOR(S) : Marjorie Croner

Figure 2:
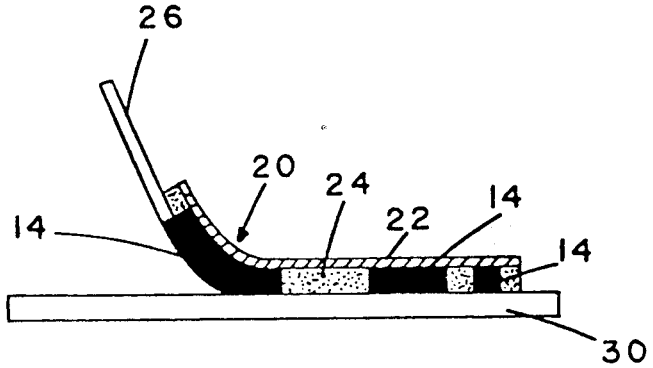

It is certified that error appears in the above-identified patent and that said Letters Patent is hereby corrected as shown below:

The Drawing Sheet should be deleted and substitute therefor the attached Drawing Sheet consisting of FIGS. 1-3.

Signed and Sealed this

Twenty-third Day of February, 1993

*Attest:*

STEPHEN G. KUNIN

*Attesting Officer*

*Acting Commissioner of Patents and Trademarks*